United States Patent [19]

Brown, Jr. et al.

[11] Patent Number: 4,543,104

[45] Date of Patent: Sep. 24, 1985

[54] COAL TREATMENT METHOD AND PRODUCT PRODUCED THEREFROM

[75] Inventors: George E. Brown, Jr.; Bruce N. Hoppert, both of Cincinnati, Ohio

[73] Assignee: Brown Coal Corporation, Cincinnati, Ohio

[21] Appl. No.: 666,135

[22] Filed: Oct. 30, 1984

Related U.S. Application Data

[63] Continuation of Ser. No. 618,779, Jun. 12, 1984, abandoned, which is a continuation of Ser. No. 442,503, Nov. 17, 1982, abandoned.

[51] Int. Cl.[4] ..... C10L 9/06

[52] U.S. Cl. ..... 44/1 SR; 44/51; 201/17

[58] Field of Search ..... 44/1 SR, 51; 201/17

[56] References Cited

U.S. PATENT DOCUMENTS

| | | | |
|---|---|---|---|
| 3,801,469 | 4/1974 | Essenhigh | 201/7 |
| 3,824,084 | 7/1974 | Dillon et al. | 44/1 SR |
| 3,960,513 | 6/1976 | Agarwal et al. | 44/1 SR |
| 3,993,456 | 11/1976 | Cole et al. | 44/1 SR |
| 4,051,043 | 9/1977 | Harter et al. | 250/531 |
| 4,081,250 | 3/1978 | Hsu et al. | 44/1 SR |
| 4,105,416 | 8/1978 | Burk, Jr. et al. | 44/1 SR |
| 4,123,230 | 10/1978 | Kirkbride | 44/1 SR |
| 4,138,724 | 2/1979 | Kawauchi | 364/500 |
| 4,210,422 | 7/1980 | Titus | 44/15 R |
| 4,224,038 | 9/1980 | Masologites et al. | 44/1 SR |
| 4,233,126 | 11/1980 | Garcia | 204/157.1 H |
| 4,260,394 | 4/1981 | Rich | 44/1 SR |
| 4,272,251 | 6/1981 | Beckberger et al. | 44/1 SR |
| 4,305,726 | 12/1981 | Brown, Jr. | 44/1 SR |
| 4,317,044 | 2/1982 | Vaseen | 422/186.3 |
| 4,325,707 | 4/1982 | Kalvinskas et al. | 44/1 SR |
| 4,328,002 | 5/1982 | Bender | 44/1 SR |
| 4,329,156 | 5/1982 | Othmer | 44/1 SR |
| 4,412,839 | 11/1983 | Taylor | 44/1 SR |
| 4,436,618 | 3/1984 | Rigby et al. | 44/1 SR |

FOREIGN PATENT DOCUMENTS

| | | | |
|---|---|---|---|
| 10289 | 4/1980 | European Pat. Off. | 44/1 SR |
| 2815180 | 10/1978 | Fed. Rep. of Germany | 44/1 SR |

*Primary Examiner*—Carl F. Dees

*Attorney, Agent, or Firm*—Wood, Herron & Evans

[57] ABSTRACT

Disclosed herein is a method for treating raw coal with ozone in aqueous suspension to modify the surface of the coal particle and release the ash constituents thereby permitting a more thorough separation of coal from ash by conventional means. The process also provides a mixture which is easily dewatered.

13 Claims, 1 Drawing Figure

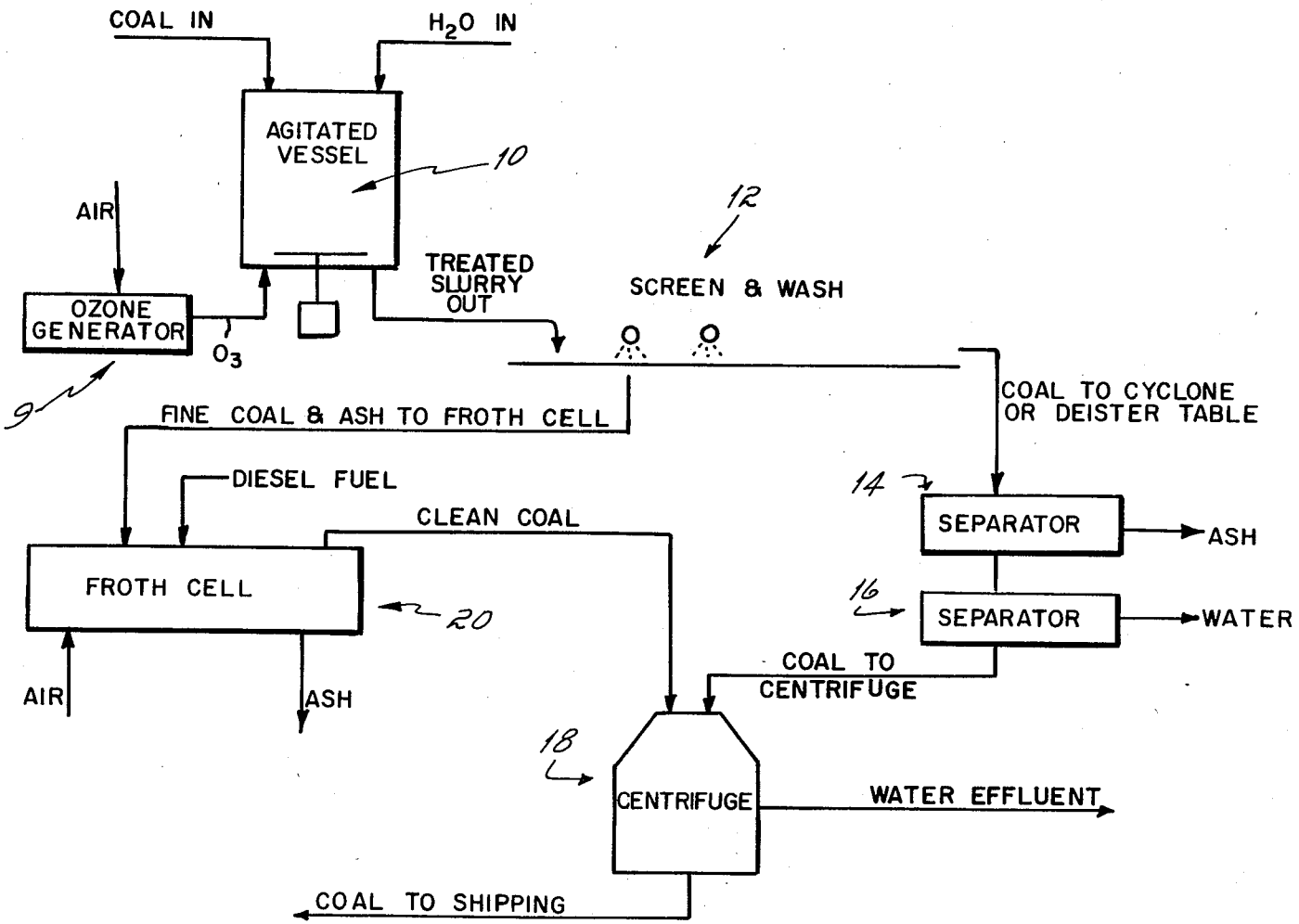
COAL IN
$H_2O$ IN
AGITATED VESSEL
10
AIR
OZONE GENERATOR
9
$O_3$
TREATED SLURRY OUT
12
SCREEN & WASH
COAL TO CYCLONE OR DEISTER TABLE
FINE COAL & ASH TO FROTH CELL
SEPARATOR
14
ASH
SEPARATOR
16
WATER
COAL TO CENTRIFUGE
WATER EFFLUENT
CENTRIFUGE
18
CLEAN COAL
DIESEL FUEL
FROTH CELL
20
ASH
AIR
COAL TO SHIPPING

COAL TREATMENT METHOD AND PRODUCT PRODUCED THEREFROM

This application is a continuation, of application Ser. No. 618,779, filed June 12, 1984 which is a continuation of application Ser. No. 442,503 filed Nov. 17, 1982, and now abandoned.

BACKGROUND OF THE INVENTION

Coal has been utilized as a fuel for many centuries, usually as it has been taken from the mine. While it has a high heat or B.T.U. value, it has the disadvantage of containing a large amount of contaminating ash. This ash consists of non-combustible materials such as clays, sand shale and other earth derived minerals. It also contains sulfur containing materials, principally pyrite or $FeS_2$ but also some organic sulfur containing compounds in the coal.

When coal is burned in a modern boiler, as for instance in an electric generating station boiler, several undesirable side reactions accompany the generation of heat. One principal one is the generation of large amounts of ash, some of which exits with the smoke, the rest falling to the bottom of the boiler for removal and disposal. This can be quite a problem since in a modern utility coal is burned at rates up to 2000 tons per hour, and 100 tons per hour consumption rates are quite common. As coal is usually purchased with 10% by weight ash content, the removal and disposal of 100 to 200 tons per hour of ash material, usually of a highly alkaline nature, presents a difficult and expensive problem. There is also a sizable environmental problem to be faced in disposing of the ash due to its high pH.

At the same time, sulfur oxides in the combustion gases are also generated. This is thought to contribute to the problem commonly known as "acid rain" making stack gas scrubbers mandatory on these boilers. The increased disposal load of the sludge from the scrubbers combined with the ash load provide formidable logistical and economic problems to the utility or other user.

When possible, utilities try to purchase coal supplies which are low in ash and sulfur contamination to lessen these problems. In fact, during the decades of the 1950's and 1960's many utilities ceased using coal and turned to oil as a fuel source, mainly to eliminate these problems. It can be appreciated that on the eastern seaboard of the United States with its high population density, the demand for electric energy and scarcity of ash disposal sites combined to make oil an attractive alternate fuel source. With the high price of oil this is no longer such an attractive alternate.

Various prior art process have attempted to solve the heretofore described problems by attempting to remove the ash and sulfur from the coal. For example, one such process using chlorine gas is disclosed in U.S. Pat. No. 4,305,726. Other typical processes are disclosed in the following patents U.S. Pat. Nos.: 4,328,002; 4,224,038; 4,210,422; and 3,993,455. While various prior processes appear to offer some advantages as compared to using a mined coal, they do not appear to have met all of the industries' needs and requirements.

SUMMARY OF THE INVENTION

Coal that has been crushed to a size range of ½ inch or less is mixed with water so as to form a mixture of about 10 to 40 percent by weight coal and preferably 20 to 35 percent by weight coal. Ozone is pumped into the bottom of the coal water mixture during agitation at a rate of about 1/10 to 5 pounds per ton of coal and preferably about ½ to 1 pound per ton of coal. After 5 to 30 minutes of reaction, at room temperature and at atmospheric pressure, a series of separation steps are employed to separate the coal from the ash and sulfur.

The objectives of this invention are to provide a product to the heat using industries which has the following characteristics:

(a) A clean fuel source, of low ash and sulfur content, and with a low moisture content;

(b) A clean fuel source that eliminates the logistical problems of freezing in the winter and spontaneous combustion during shipping in the summer;

(c) A clean fuel source that is economical to produce, drastically cuts shipping costs at the boiler, reduces the load on the scrubber and the sludge disposal costs, and reduces the moisture content thereby eliminating the evaporation loss of heat during burning;

(d) A clean fuel source that may be prepared from an almost unlimited supply of raw material including surface or deep-mined coal, waste coal from slurry ponds or gob piles, or lignite deposits;

(e) A clean fuel source which reduces adverse environmental impact by converting the high pH ash and sludge problem at the boiler to production of a high ammonium and nitrate ion containing topsoil product at the preparation plant to aid in restoring the ground where the mining has taken place and which reduces sulfur values which helps to reduce the "acid rain" problem;

(f) A clean fuel source that helps to broaden the use of coal by increasing the free swelling index or "coke button" value of the processed coal thus enabling the metals industry to use lower price coal for coking purposes;

(g) A clean fuel source for use in conversion to liquid form as for instance coal-oil mixes, coal-oil-water mixes, coal-water mixes, and coal derived liquid hydrocarbons thus permitting oil burning utilities to convert to coal burning utilities with a minimum of changeover costs; and (h) A clean fuel source for use in coal gasification to increase production and reduce plugging and fouling of gasifiers by supplying a fuel source of lower ash and moisture content and higher permeability and surface area for faster more complete gasification.

DESCRIPTION OF THE PREFERRED EMBODIMENT

While we do not wish to be bound by any particular theory of why the instant process produces the excellent results obtained our theory, if correct, may serve to explain the results and thus provide a better understanding of the process. Ash constituents are found in layers of various thickness throughout the coal, loosely bound to the coal molecules by weak chemical bonds. It was found that these bonds could be broken and the coal separated and further modified by the use of high energy compounds. It was also found that this transformation was not pH dependent, but only energy dependent, and could be accomplished by either oxidation, reduction or both, and could be done in aqueous medium thereby eliminating expensive dry processing techniques.

The preferred embodiment of the invention utilizes ozone, a triatomic form of oxygen, of high energy, to accomplish the initial bond breaking between the coal and the ash constituents. The following constitutes a description of how the process can be employed.

In addition to the exceptional reductions of sulfur and ash by an economical process several other surprising and unexpected results are obtained through the use of the instant process. Quite unexpectedly, a coal product is produced which is very hydrophobic in nature. Due to this the water may be easily, as compared to prior art processes, separated from the coal-water mixture obtained thus substantially decreasing processing costs as well as producing an improved product. The unique nature of the coal particles produced also is believed to be the reason why the coal does not freeze as readily in winter as compared to prior art processed coal. More particularly, it is believed that whatever ice exists does so in discrete particles rather than acting as a bridge between coal particles.

Quite unexpectedly, the coal produced by the present process has a very high coke button value, making certain types of coal very suitable for use in producing metallurgical coke. In fact, one skilled in the art would be led to believe that ozone treatment as described would lower the coke button value since it is known that the button is reduced due to oxidation of the coal.

The present process provides a final coal product that is very low in ash and sulfur. This is in part due to the unique sequence of separation steps employed. More particularly, and in contrast to prior art processes, a water separation step is employed immediately after the coal-water mixture is treated to separate the ash and sulfur components. Conventional processes do not employ a water separation step at such an early point in the process. It is believed that such an early separation step contributes significantly to the improved results, especially ash and sulfur reduction, obtained by the present process.

The coal, preferably in a size range of ½" down is pulped with water and placed in an agitated vessel 10 to form a coal water mixture. The mixing device shown in U.S. Pat. No. 3,420,454, incorporated by reference herein, with slight modifications has been found to be useful. The apparatus of FIG. 5 is preferred. The mixture to the vessel 10 comprises 10 to 50 percent by weight coal and preferably 16 to 25 percent by weight coal.

Referring to the diagram, ozone, prepared by convention means 9, i.e., by high voltage corona contact with air, is pumped into the bottom of the agitated vessel 10. The amount of ozone required will vary depending on the amount of ash in the coal and on other properties of the coal. While there will be some variance it has been found that about ⅓ to 5 pounds of ozone per ton of coal will suffice with the preferred range usually being ½ to 1 pound. The ozone, being unstable in the presence of water, rapidly breaks down releasing atomic oxygen of high energy content. It is believed that the ozone breaks the bond between the coal and the ash constituents, and further attacks the organic molecules in the coal particle, opening ring structures (benzene types) and converting the coal into a highly hydrophobic particle. In addition, it is believed that the coal-ash bond breaking proceeds along the boundary layer, opening up channels in the cellular nature of the coal and further reducing particle size as the ash-boundary layer weakens and breaks. The clean hydrophobic coal particle is then free to further react on the surface to open ring structures and break aliphatic chains, particularly at the sulfur bonds which are much weaker than the carbon bonds in the coal structure.

After a suitable period of reaction time, usually from 5 to 30 minutes and preferably from 10 to 20 minutes, carried out at room temperature and atmospheric pressure, the coal-water mixture is pumped to a suitable screen 12 of conventional design where the coal is washed and drained on a 150 mesh wire cloth. A different mesh could be employed depending on the economics of the recovery process. Depending on the particular system, one may desire to accomplish this screening step in a plurality of stages. The largest part of the ash constituents are removed on the screen along with the less than 150 mesh coal. The retained product is then fed to separating equipment 14 of either conventional centrifugal cyclone type or gravity Deister table type (Deister is a trademark for separating equipment sold by Deister Concentrator Company Inc. of Fort Wayne, Indiana) where the larger heavier type ash particles are removed. This product is then rescreened on a conventional mesh screen 16 to remove excess water and fed to a centrifugal dryer 18 of conventional design. Here the hydrophobic nature of the coal particles manifests itself in achieving dryness levels of 6 to 10% moisture on 28 mesh coal, as contrasted to the usual level of 16–21% moisture.

The underflow from the first separating screen is pumped to a froth flotation cell 20 of conventional design where diesel fuel is added. Approximately ¼ to 2 percent by weight and preferably ½ to 1 percent diesel fuel or similar material such as pure oil is employed. Here again, the extremely hydrophobic nature of the coal displays itself in the rapid agglomeration of the coal by the diesel oil on the organophillic coal particles. Collection of the froth and allowance of the froth to collapse and dewater yields a low ash and moisture coal product, far in excess of what can be standardly expected from these cells.

The remaining ash constituents along with the nitrogen compounds (both oxidized and reduced), are settled from the water stream and used to restore the environment of the strip mined areas, as the growth support qualities of the ash are exceptional. Nitrogen values increase in the ash material range from ½% to 5% depending on what is desired in the area to be restored.

At this point the coal can be used as an energy source. If desired, and it is not required, a further treatment of the coal after it passes through centrifuge 18 can be provided.

For example, the coal can be put in a slope bottomed tank not shown so that it flows across a metal contact plate in the bottom, with a surface contact plate in the water containing a small percentage of sodium hydroxide. An electric potential of about 6 to 24 volts at from 6 to 100 amps is then applied and the coal itself in contact with the bottom plate, becomes the electrode in an electrolytic cell, in this case the cathode. It is believed that sodium ions attracted to the coal, are neutralized to sodium atoms, and immediately react with the water to form nascent hydrogen. This combination of nascent sodium (high energy) and nascent hydrogen (also high energy) completes the cleaning action by solublizing silica as sodium silicate, and further reducing pyritic material and organic sulfur to hydrogen sulfide. Coal product from the reduction step is thereafter screened and centrifuged to a very low dryness.

The coal produced has different surface characteristics than coal produced by other methods. The particles are exceptionally clean and have very high light reflective values. Under microscopic examination, the coal particles show very little or no ash or sulfur entrapped within the particles. What little that does exist does so in separate and discrete particles.

Specific examples of coals from various sources treated by one or both steps and the ash and sulfur reductions and moisture levels attained and enhanced B.T.U. values may be attained in accordance with the following examples:

EXAMPLE 1

Eastern Kentucky Coal - 42% ash, 1.4% sulfur, 6700 B.T.U. no F.S.I. treat at 25% solids using 30# of coal and 30 grams of $O_3$ for 30 minutes while being agitated. After screening and passage across a Deister table, in accordance with the above procedure, the product is centrifuged to an 8% moisture level with the following approximate values. 3.1% ash, 0.6% sulfur, 13,850 B.T.U. and an 8½ F.S.I.

EXAMPLE 2

Alabama Coal - 36% ash - 1.7% sulfur, 8000 B.T.U. treat at 25% solids using 30# of coal and 30 grams of $O_3$ for 30 minutes while being agitated. After screening and passage across a Deister table in accordance with the above procedure, the following approximate values are obtained. Ash 2.91%, sulfur 0.7%, 13,940 B.T.U. 9% moisture.

EXAMPLE 3

Alabama lignite - 28% ash, 24% moisture, 4.2% sulfur, 5200 B.T.U. treat at 25% solids using 30# of lignite and 45 grams of $O_3$ for 30 minutes while being agitated. After screening and passage across a Deister table the following approximate values are obtained. Ash 3.2%, sulfur 1.7%, B.T.U. 13,740, moisture 6.8%.

EXAMPLE 4

Illinois Coal - 52% ash, 2.1% sulfur, 4,850 B.T.U. No F.S.I. treat at 25% solids using 30$ of coal and 60 grams of $O_3$ while being agitated. After screening and passage across a Deister table the following approximate values are obtained. 4.08% ash, 0.9% sulfur, 13,600 B.T.U., 6½ F.S.I. 8.2% moisture.

EXAMPLE 5

Coal from run #4 from Illinois is mixed with water to a 25% moisture level and placed in a polyethylene bag and put in a refrigerator freezer compartment for 24 hours at 0° F. At the end of 24 hours the coal is free flowing and easily handled without the formation of frozen lumps. It is also true of Eastern Kentucky Coal. The ice crystals are discrete and are not attached to the coal particles.

EXAMPLE 6

Ohio Coal - 24% ash, 6.5% sulfur, 8,350 B.T.U. treat at 25% solids using 30# of coal and 60 grams of $O_3$ while being agitated. After screening and passage across a Deister table the following approximate values are obtained. 3.8% ash, 1.6% sulfur, 13,450 B.T.U.

Having described our invention, we claim:

1. In a process for treating crushed coal to remove sulfur and ash therefrom, wherein an agitated coal-water mixture is prepared on the basis of a solids content of about 10 to 40% by weight and ash and sulfur are subsequently removed by mechanical separation the improvement that comprises introducing into said mixture about 1/10 to 5 pounds of ozone per ton of coal and continuing to agitate said mixture for about 5 to 30 minutes.

2. The process of claim 1 wherein about ½ to 1 pound of ozone is used.

3. The process of claim 2 wherein after treatment with said ozone the coal-water mixture is rendered alkaline and subjected to an electric potential of about 6 to 24 volts at 6 to 100 amps.

4. A process for removing sulfur and ash from coal comprising:

crushing the coal to a size of about ½ inch and less;

adding water to the crushed coal so as to provide a coal-water mixture having a solids content of about 10 to 40% by weight;

agitating said mixture;

contacting said mixture with ozone in an amount of about 1/10 to 5 pounds of ozone per ton of coal for about 5 to 30 mintues;

separating coal and ash from said mixture.

5. The process of claim 4 wherein ½ to 1 pound of ozone is utilized.

6. The process of claim 5 wherein the separation of the coal and ash is effected by centrifugal means and by flotation means.

7. The process of claim 6 wherein sodium hydroxide is added to the coal-water mixture and an electric potential of 6 to 24 volts at 6 to 100 amps is applied.

8. The process of claim 2 wherein the agitation is at room temperature and at atmospheric pressure.

9. The process of claim 4 wherein the agitation is at room temperature and at atmospheric pressure.

10. A process for improving the hydrophobic properties of a coal-water mixture consisting essentially of treating the coal-water mixture with ozone in an amount of about 1/10 to 5 pounds of ozone.

11. The process of claim 10 wherein the coal-water mixture has a solids content of about 10 to 40% by weight.

12. The process of claim 11 wherein ½ to 1 pound of ozone is utilized and said mixture is agitated for at least 5 minutes.

13. The process of claim 12 wherein the process is practiced under substantially ambient conditions.

* * * * *